US007153245B2

(12) United States Patent
Kim

(10) Patent No.: US 7,153,245 B2
(45) Date of Patent: Dec. 26, 2006

(54) GOLF EXERCISER

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 326 days.

(21) Appl. No.: 10/075,204

(22) Filed: Feb. 14, 2002

(65) Prior Publication Data

US 2003/0153440 A1 Aug. 14, 2003

(51) Int. Cl.
*A63B 21/00* (2006.01)

(52) U.S. Cl. ..... 482/121; 482/122; 473/409

(58) Field of Classification Search ..... 482/121–129, 482/130, 904, 135–138, 97–100; 601/23, 601/5, 33–35; 434/247, 248, 252; 473/207, 473/212, 215, 216
See application file for complete search history.

(56) References Cited

U.S. PATENT DOCUMENTS 2,848,234 A * 8/1958 Brandon ..... 473/229
3,462,156 A 8/1969 Gentry ..... 273/186
3,703,294 A * 11/1972 Fitch ..... 473/229
4,749,189 A 6/1988 Frank ..... 272/136
4,828,253 A * 5/1989 Schicketanz ..... 482/92
5,016,874 A * 5/1991 Boardman
5,158,299 A 10/1992 Otter ..... 273/186.2
5,419,550 A * 5/1995 Blom
5,431,617 A * 7/1995 Rattray, Jr. ..... 482/129
5,586,962 A * 12/1996 Hallmark ..... 482/129
6,004,248 A * 12/1999 Price ..... 482/121
6,267,711 B1 * 7/2001 Hinds
6,280,361 B1 * 8/2001 Harvey et al.
6,558,302 B1 * 5/2003 Cluff ..... 482/129

* cited by examiner

*Primary Examiner*—Jerome Donnelly
(74) *Attorney, Agent, or Firm*—Brown & Michaels, PC

(57) ABSTRACT

A golf swing exerciser uses two lengths of resistance cords or tension elements connected to an exercising handle so that one of the cords extends to an upper resistance region on a back swing side of the exerciser and the other resistance cord extends between upper and lower resistance regions on a back swing side of the exerciser. The cord from the upper resistance region resists downward movement of an exercising handle from a back swing region, and the cord extending between the upper and lower resistance regions resists lateral movement of the handle into a hitting region. The combined resistance of both cords significantly increases as the handle moves into the hitting region.

25 Claims, 10 Drawing Sheets

GOLF EXERCISER

TECHNICAL FIELD

Equipment for strengthening muscles used in swinging motion for golf.

BACKGROUND

The prior art has generally recognized the benefits of strengthening muscles needed for swinging sports implements, and specifically for golf club swinging muscles, the prior art contains several suggestions. All of these are problematic for various reasons and none has become widely used.

Most of the patents suggesting golf swing exercisers apply a swing resistance that remains in a fixed location during the swing. This fails to orient the resistance in an effective direction throughout the swing, as can be seen from U.S. Pat. Nos. 4,229,002; 4,135,714; 4,253,663; 3,462,156 and 3,966,203.

A few other patents, including U.S. Pat. Nos. 5,050,874 and 5,284,464 suggest a swing resistance mounted on a central pivot so that the resistance follows a circular arc as the swing proceeds. This also is less than optimum, because a golf swing differs significantly from a circular arc.

Another U.S. Pat. No. 5,242,344 suggests a more complex movement of a swing resistance, but this requires a cumbersome and complex machine.

My invention aims at a swing exerciser applicable and especially suitable for exercising muscles used in a golf swing by applying a resistance in an amount and a direction that are effectively matched to the force and direction requirements of the swing. My invention also keeps the necessary equipment simple so that swing exercising can be accomplished in an especially effective way without undue expense.

SUMMARY

My swing exerciser is especially appropriate for a golf swing, since a golf swing extends through many feet of a complex curve as it proceeds from a back swing region to a hitting region. My invention keeps a resistance properly oriented to effectively resist advance of a golf handle through different regions of a golf swing so that a golf exerciser can feel comfortable and natural in a swing exercise.

Since most of the muscle force applied in hitting a golf ball is concentrated in the swing's approach to a hitting region, my invention applies significantly increased resistance in this region of the swing. This makes the muscles work especially hard as the golf handle approaches the hitting region, which effectively develops the muscle strength necessary for applying power to the golf swing.

My swing exerciser accomplishes these benefits with a resistance system that uses two lengths of cords or tension elements connected to an exercising handle to apply elastically deformable resistance to movement of the handle through a golf swing. Both of the resistance or tension elements are arranged on a back swing side of the exerciser to apply resistance to movement of the handle downward from the back swing region and forward into the hitting region. A first one of the tension elements is deployed from an upper tension region above the exerciser's shoulder to resist downward movement of the handle, and a second one of the tension elements extends from the handle to both the upper tension region and a lower tension region to resist movement of the handle forward into the hitting region. The combined resistances of the first and second elements are preferably greatest as the handle enters the hitting region.

DRAWINGS

Figure 5A:
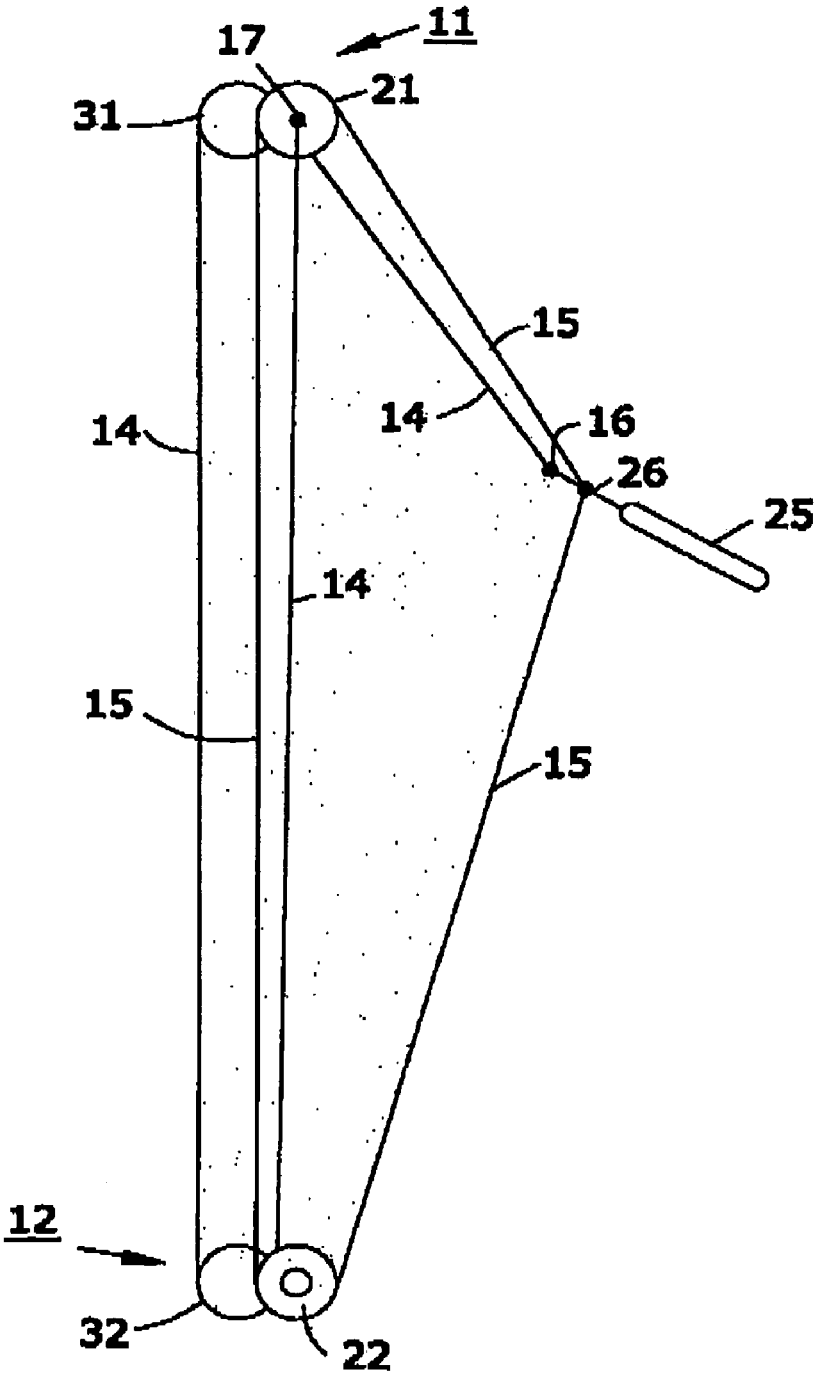

FIGS. 5A and B and FIGS. 6–9 schematically show several preferred embodiments of the inventive exerciser using different arrangements of tension cords and elastically deformable elements.

DETAILED DESCRIPTION

Figure 1:
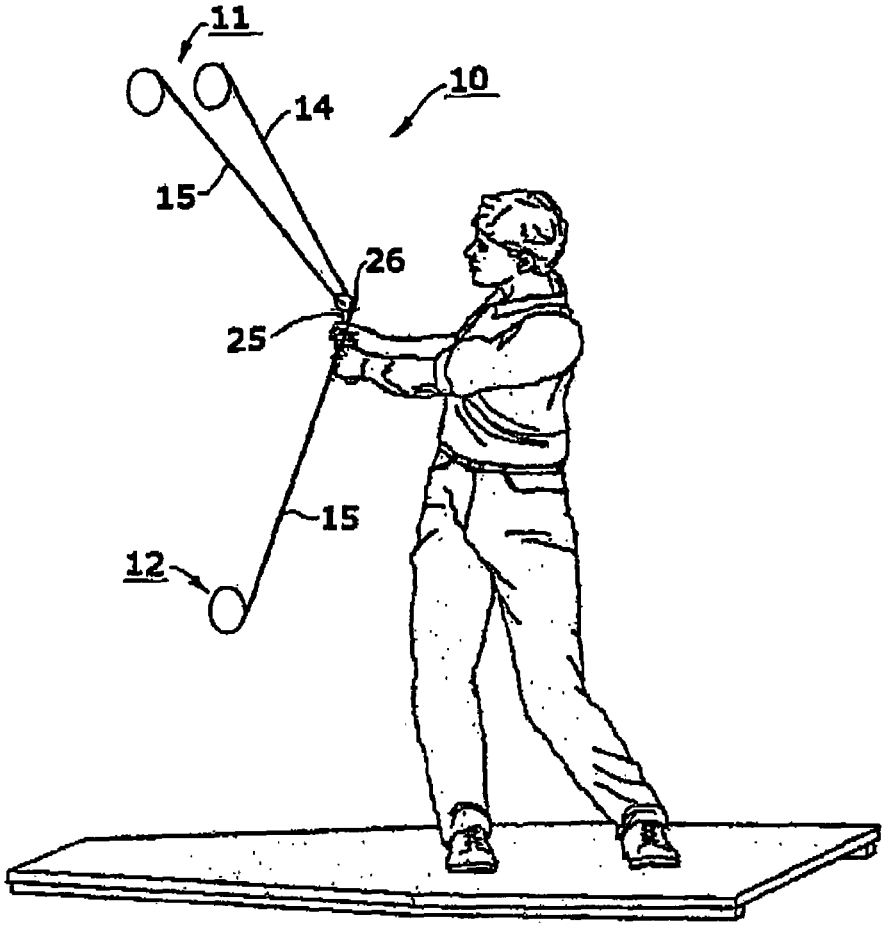
FIGS. 1 and 2 show a partially schematic preferred embodiment of the inventive golf exerciser used in the back swing position in FIG. 1 and in the hitting region in FIG. 2.
Figure 2:
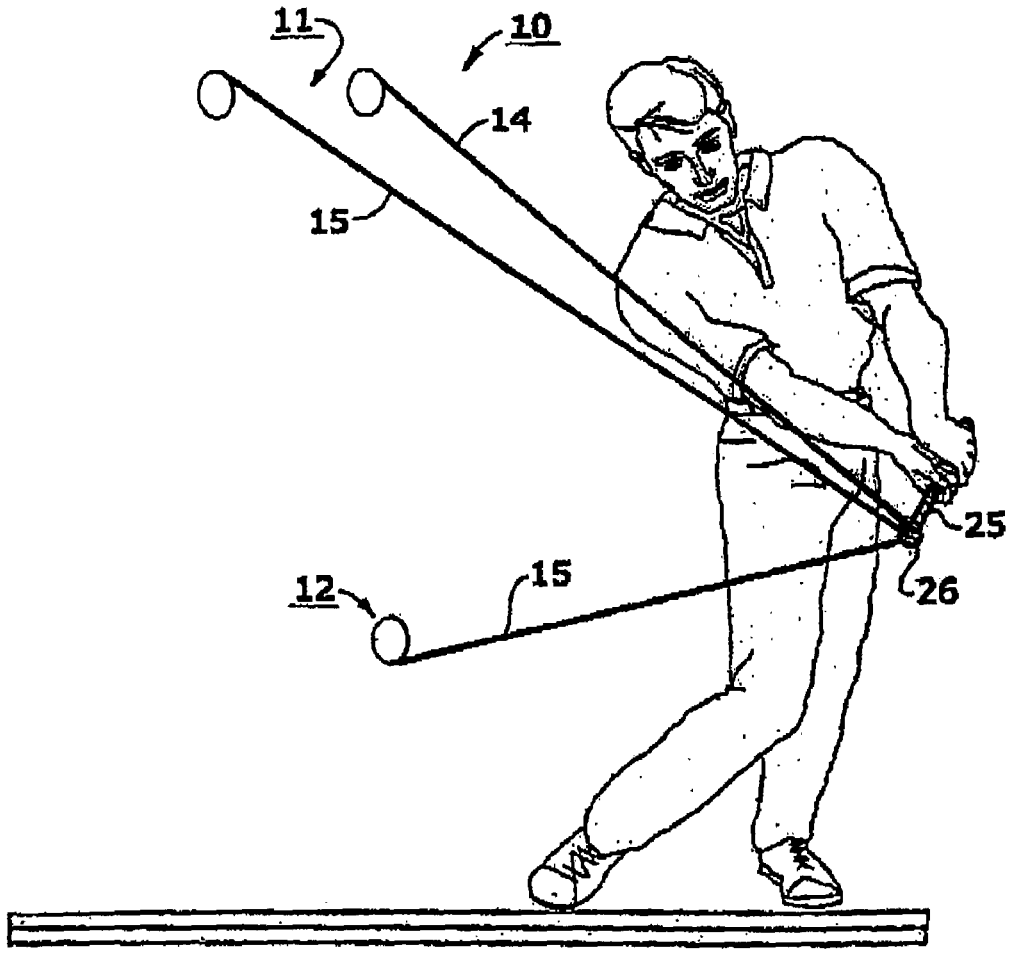

As shown schematically in FIGS. 1 and 2, a golf exerciser wields a handle 25 connected to cords or tension elements that effectively resist movement of handle 25 through the complex curve of a golf swing for exercise purposes. The cords, tension elements, and resistance system are explained more fully below, and the purpose of the illustrations of FIGS. 1 and 2 is to show the positional deployment of the resistance system relative to the golf swing exerciser.

The inventive golf swing resistance system 10 is arranged on a back swing side of the exerciser and includes an upper resistance region 11 and a lower resistance region 12. One tension element 14 extends from upper resistance region 11 to handle 25, and another tension element 15 extends between upper resistance region 11 and lower resistance region 12 while passing over or through either a pulley or low friction element 26 on handle 25. Resistance cord 14 primarily resists downward movement of handle 25 from a back swing region shown in FIG. 1 to a lower hitting region shown in FIG. 2. Resistance element 14 can also add some increasing resistance as handle 25 moves through the hitting region shown in FIG. 2. Resistance cord 15 primarily resists movement of handle 25 away from upper and lower resistance regions 11 and 12 and into the hitting region shown in FIG. 2. Cord 15 offers relatively little resistance to downward movement of handle 25 from the back swing region of FIG. 1.

The combined resistance of cords 14 and 15 is greatest as handle 25 approaches and passes through the hitting region of FIG. 2 so as to require maximum muscle force by the exerciser in moving handle 25 through the hitting region. The combined effect of resistance elements 14 and 15 is predetermined to allow the exerciser to swing handle 25 realistically through the curve of a golf swing and to provide appropriate resistance along each increment of the swing so the exerciser can strengthen the muscles used in a golf swing. Although each of the tension elements 14 and 15 provides some resistance to the golf swing, the combined effect of both elements 14 and 15 is necessary to optimize resistance forces to be overcome during swinging exercise. Downward resistance is necessary to develop muscles that drive a golf club head downward into the hitting region, and lateral resistance is necessary to strengthen muscles that are needed to drive a golf club head forward through the hitting region.

Figure 3:
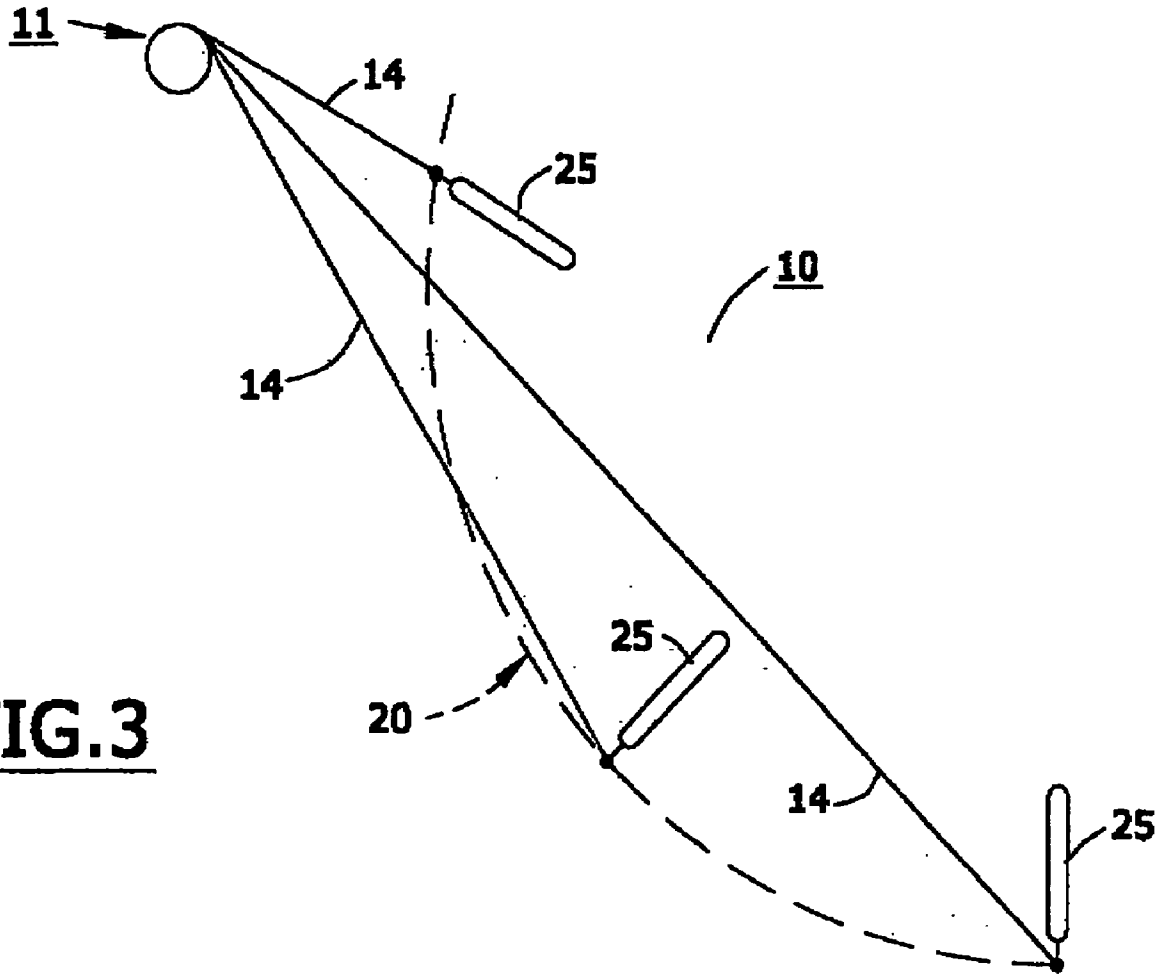
FIGS. 3 and 4 are schematic diagrams of approximate forces and directions involved in the inventive exerciser as represented by resistance cord lines extending from a golf handle to an upper resistance region in FIG. 3 and to upper and lower resistance regions in FIG. 4.

FIG. 3 schematically shows the resistance function of tension element 14 as handle 25 moves through the broken line curve 20 of a golf swing. Cord 14 is shortest as it extends from upper resistance region 11 to handle 25 at the upper back swing region, and as handle 25 moves downward along curve 20 to a mid swing region, tension cord 14 elongates considerably to provide resistance to downward handle movement. As handle 25 moves on to the hitting region at the lower end of swing curve 20, tension element 14 elongates further.

Figure 4:
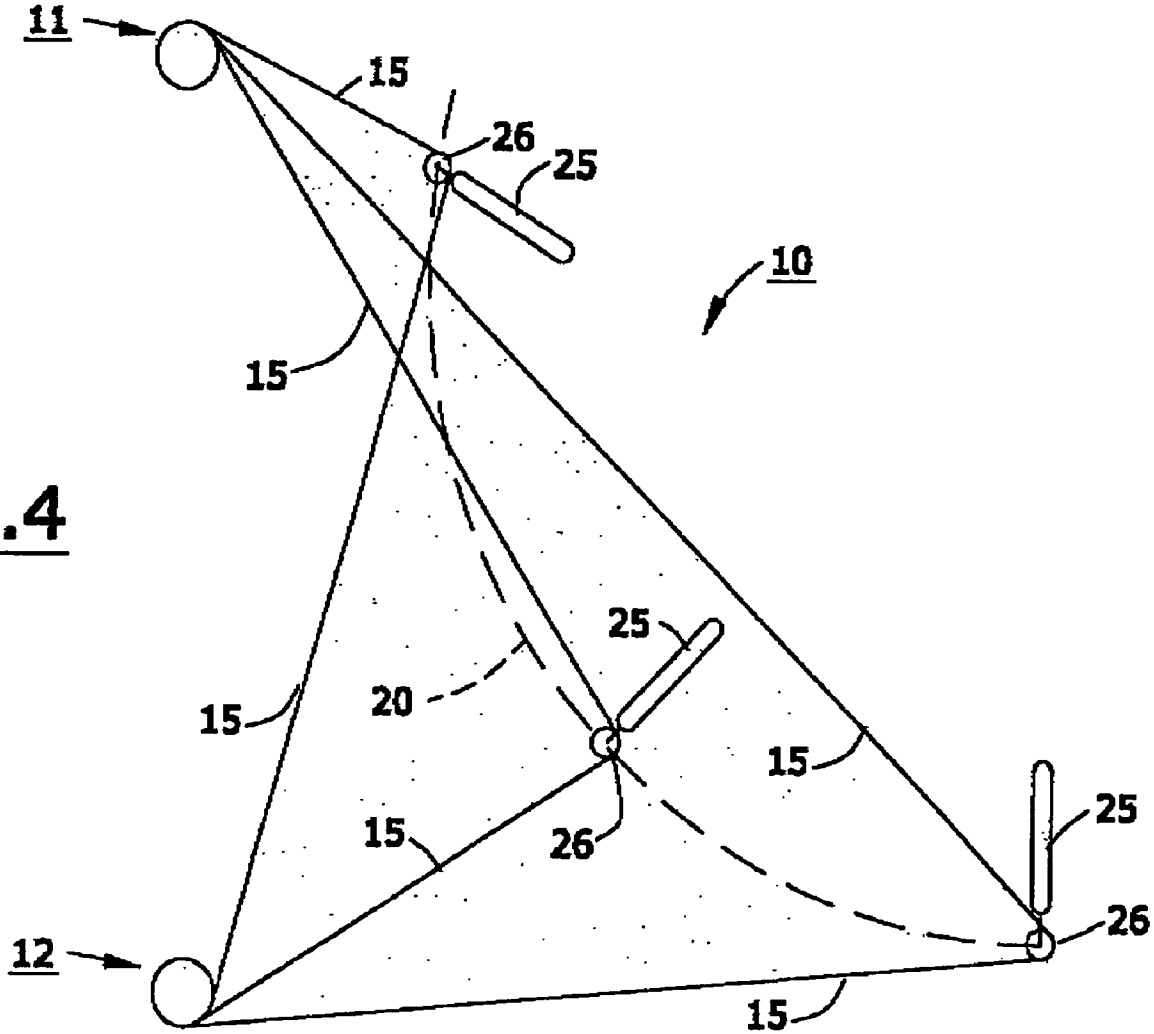

Tension element 15, as schematically shown in FIG. 4, extends between upper resistance region 11 and lower resistance region 12 and over a pulley or low friction element 26 on handle 25. As handle 25 moves from the back swing position to the mid swing position, cord 15 rolls over pulley 26 and is elongated only slightly, to provide little resistance to such downward movement. As handle 25 advances into the hitting region shown at the lower end of swing curve 20, tension element 15 elongates considerably because of the movement of handle 25 away from upper and lower resistance regions 11 and 12. This allows tension element 15 to provide strong resistance to the movement of handle 25 through the hitting region so as to require strengthening of golf hitting muscles from driving handle 25 through the hitting region.

The combined effect of resistance cords 14 and 15 provides resistance to handle movement downward from the back swing region and then gradually and significantly increased resistance to movement of handle 25 into the hitting region. Repeatedly swinging handle 25 through swing curve 20 against the resistances provided by cords 14 and 15 strengthens an exerciser's golf hitting muscles and improves golf hitting ability.

Figure 5B:
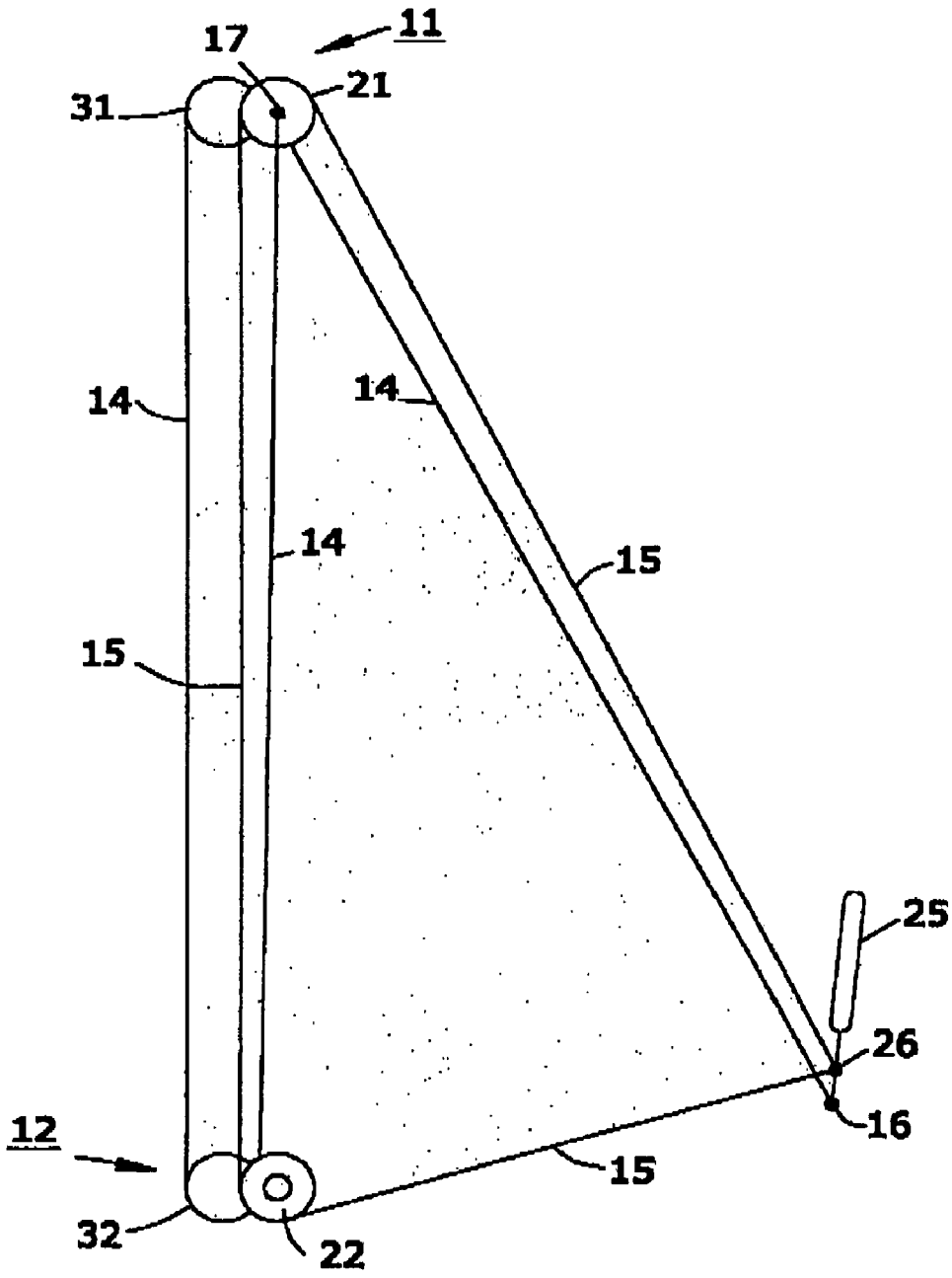

FIGS. 5A and B show one preferred embodiment arranged to accomplish the functions described above with handle 25 in the back swing position in FIG. 5A and in the hitting position in FIG. 5B. Upper resistance region 11 mounts two fixed pulleys 21 and 31, and lower resistance region 12 mounts another pair of fixed pulleys 22 and 32. Tension element 14 extends from a fixed connection 16 on handle 25 over pulleys 31 and 32 to an opposite end 17 fixed in upper tension region 11 on pulley 21, for example. Cord 14 is formed of an elastomerically stretchable material such as a bungie cord or tube that can stretch, resist stretching, and can retract from a stretched position. As handle 25 moves from the back swing position of FIG. 5A to the hitting position of FIG. 5B, cord or tube 14 elongates as it rolls over pulleys 31 and 32 to provide resistance to movement of handle 25.

Tension cord 15 is formed as a continuous loop reeved over fixed pulleys 21 and 22, and over pulley 26, which is moveable with handle 25. Cord 15 is also formed of an elastomeric strand or tube that stretches resistantly when handle 25 moves from its back swing to its hitting positions. The combined resistance of cords 14 and 15 is greatest as handle 25 moves through the hitting region of FIG. 5B.

Figure 6:
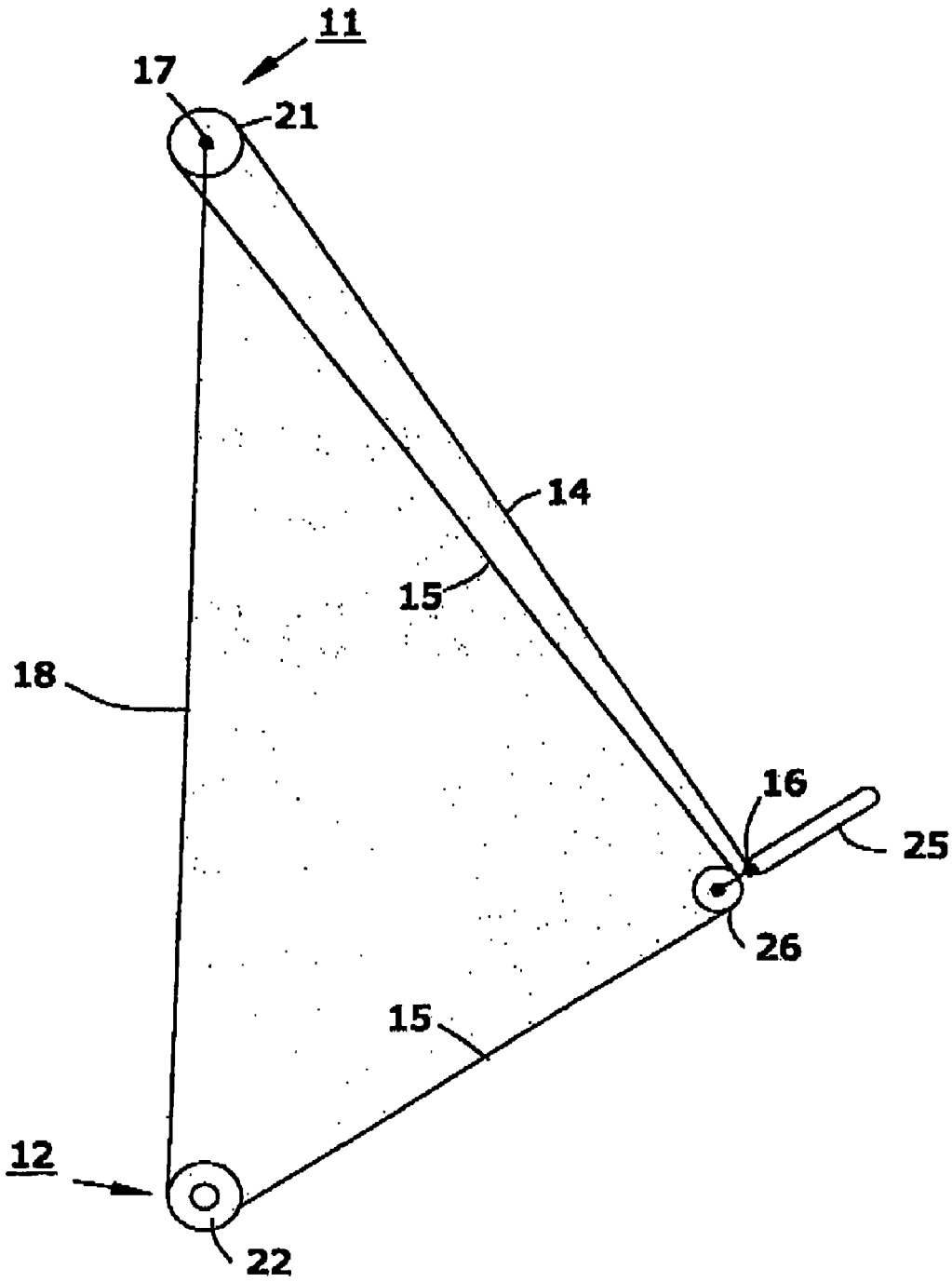

FIG. 6 schematically shows a simpler preferred embodiment using a single fixed pulley 21 in upper resistance region 11 and a single fixed pulley 22 in lower resistance region 12. This embodiment also uses a single resistance cord 18 having one end connected to handle 25 at point 16 to extend as tension cord 14 over upper pulley 21. After rounding upper pulley 21, the elastomeric cord serves as tension element 15 extending from pulley 21 back to pulley 26 on handle 25, down to lower resistance region pulley 22, and back up to fixed end 17 at upper pulley 21. The extension of elastomeric element from pulley 21 over pulley 26 and down to pulley 22 provides the previously described function of tension cord 15, as indicated. Cord 18 provides the elastomeric extent necessary for stretching resistance of cords 14 and 15 to accomplish the previously described resistance functions. The embodiment of FIG. 6 has the advantage of accomplishing all this with a single cord and minimum pulleys.

Figure 7:
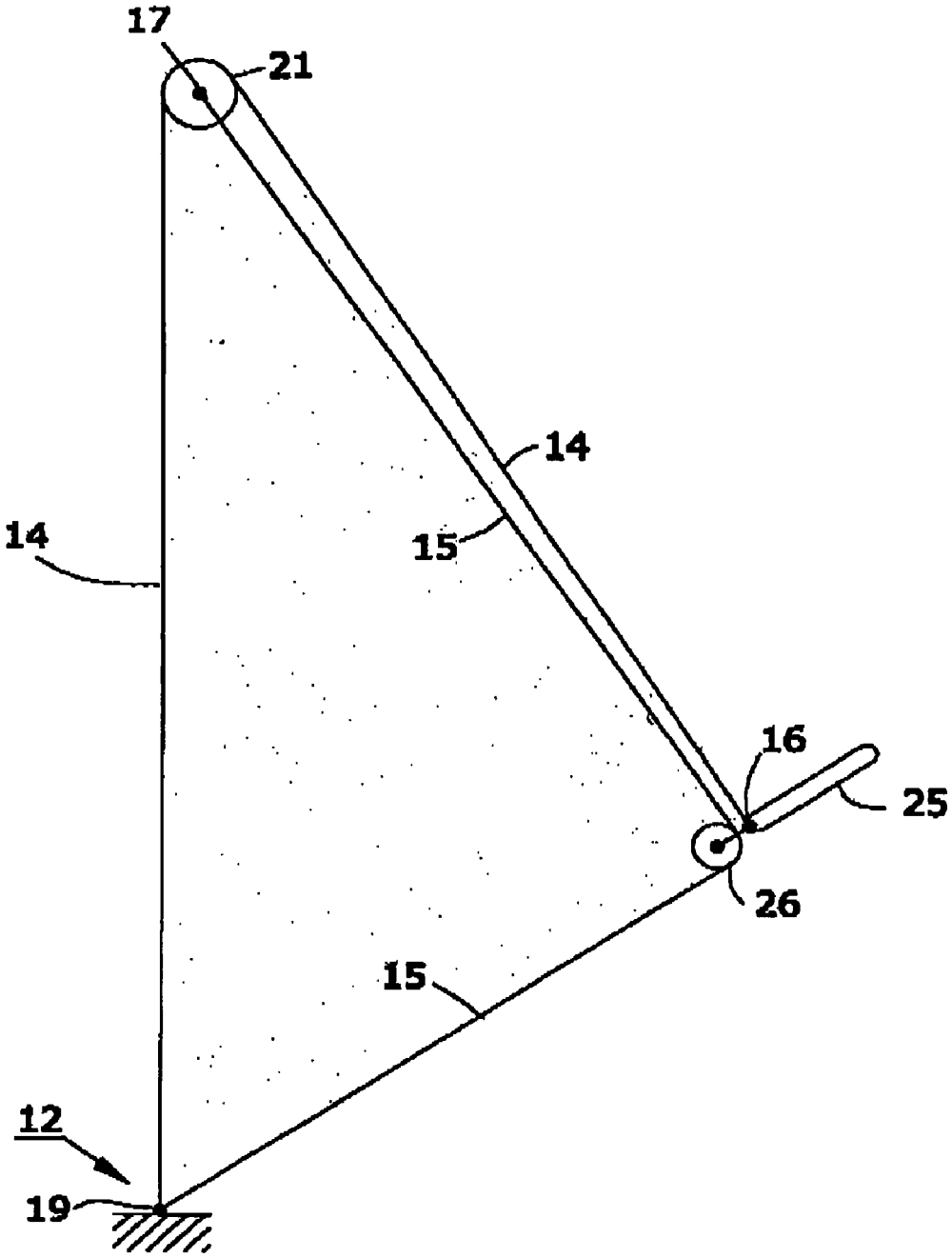

The embodiment of FIG. 7 shows an even further simplification using a single fixed pulley 21 and a moveable pulley 26 on handle 25. An elastomerically stretchable resistance cord 14 extends from one end 16 fastened to handle 25 over pulley 21 and down to a fixed connection 19 at lower resistance region 12. Resistance cord 15 extends from a fixed connection 17 at pulley 21, over pulley 26 and down to the same end connection 19 at lower resistance region 12. This economizes on pulleys, but gives resistance cord 15 a shorter stretchable length that requires selection of suitable elastic material. The functions of cords 14 and 15 remain as previously described for other embodiments.

Figure 8:
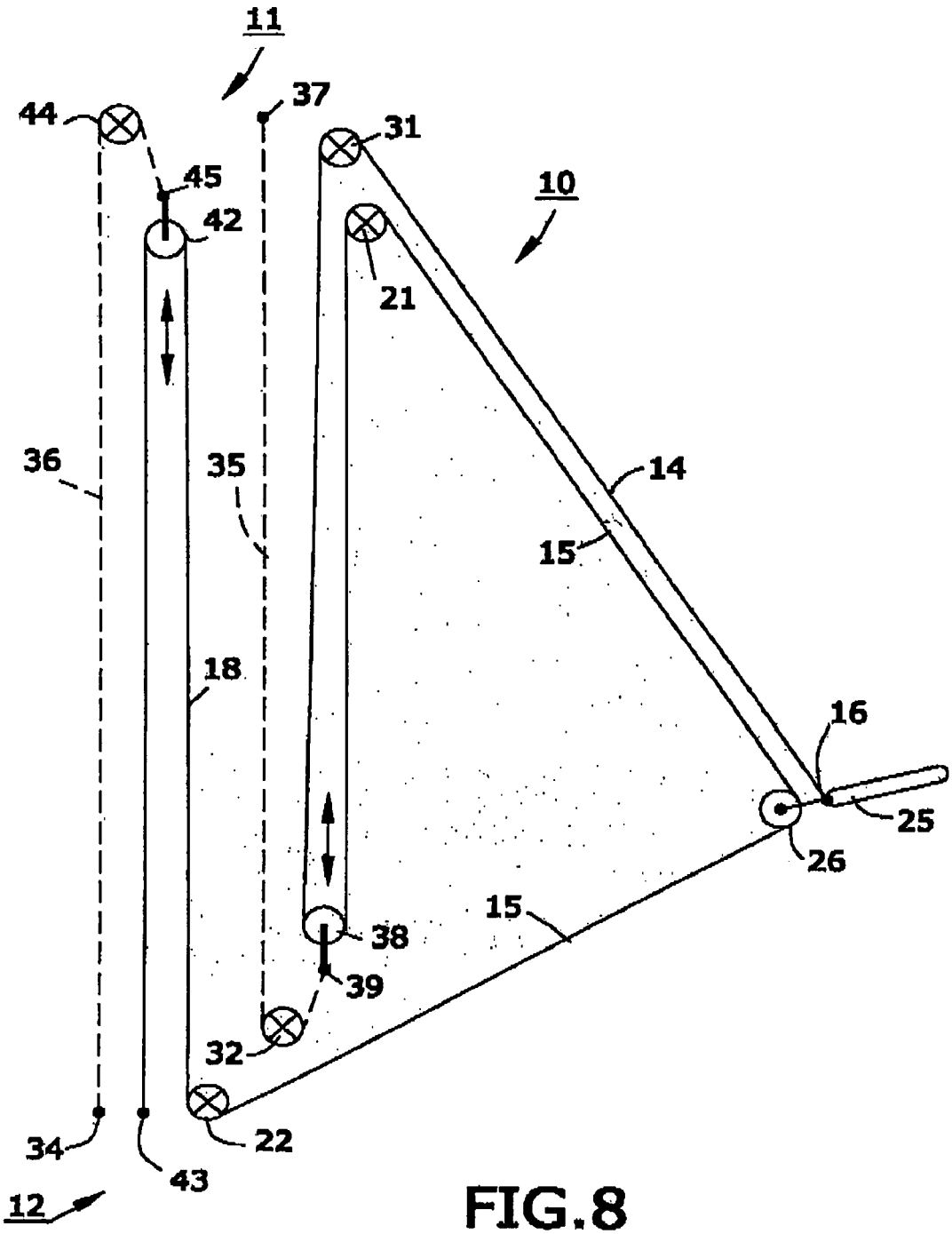

The embodiment of FIG. 8 schematically illustrates the possibility of using a combination of inelastic cords and elastically deformable tension elements. It uses a single cord 18 that is essentially inelastic or not especially stretchable to provide the functions of both cords 14 and 15. Cord 14 extends from one end 16 fastened to handle 25 upward over fixed pulley 31 downward to moveable pulley 38 and back up to fixed pulley 21. From pulley 21 downward over handle pulley 26 and downward to fixed pulley 22 upward to moveable pulley 42 and downward to fixed end 43 serves as tension cord 15. The movement of moveable pulleys 30 and 42 is resisted by respective elastomeric resistance elements 35 and 36. These can be extension springs or elastomeric cords or tubes whose extension provides the necessary resistance for system 10. Elastically deformable element 35, shown in broken lines, extends from a fixed end 37 over fixed pulley 32 and up to an opposite end 39 connected to moveable pulley 38. In a similar way, elastomerically extendable element 36, also shown in broken lines, extends from a fixed end 34 up over a fixed pulley 44 and down to an opposite end 45 connected to moveable pulley 42. Movement of pulleys 38 and 42 are indicated by double headed arrows.

As handle 25 moves through an exercising swing curve, tension elements 14 and 15 follow the handle movement, which necessarily extends elastomeric elements 35 and 36 to provide the necessary swing resistance. Again, this resistance is maximum when handle 25 is moved through a hitting region.

Figure 9:
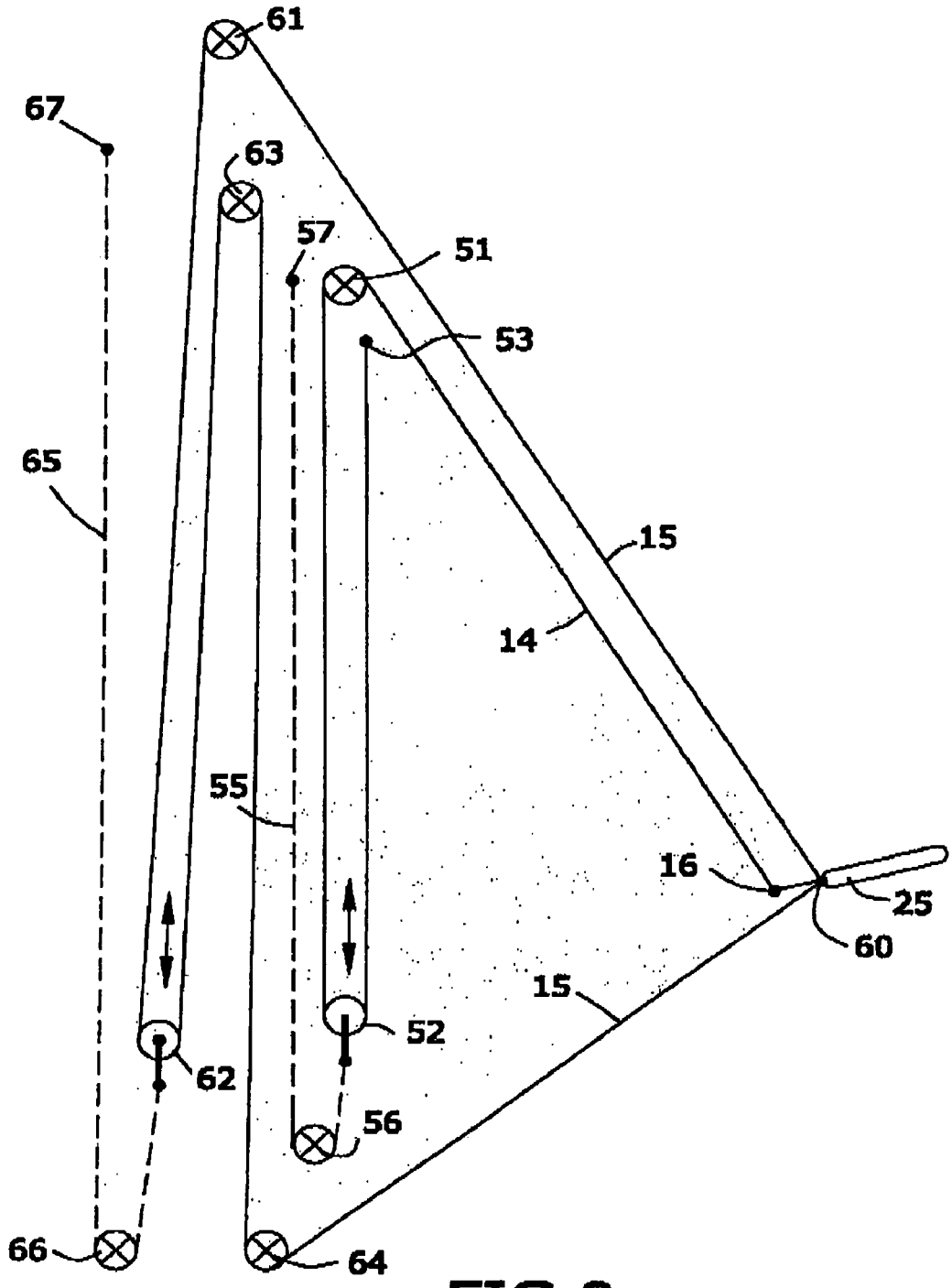

The embodiment of FIG. 9 illustrates another possibility also using a combination of inelastic cords and elastically stretchable cords. It includes exercising handle 25 to which, are connected inelastic cord 14 providing predominantly downward resistance and cord 15 providing predominantly horizontal resistance. Cord 14 extends from one end 16 fastened to handle 25 upward over fixed pulley 51, downward to moveable pulley 52 and back up to fixed end 53. Movement of pulley 52 is resisted by elastically stretchable cord 55 connected to pulley 52 and reeved over fixed pulley 56 and extending up to fixed end 57. As handle 25 moves downward from a back swing or upper tension region in the vacinity of fixed pulley 51, cord 14 pulls upward on moveable pulley 52, which stretches elastic cord 55 to resist such downward movement.

Inelastic cord 15 is formed as a loop having both ends connected to handle 25, preferably at point 60. From there, an upper reach of cord 15 extends over fixed upper pulley 61, down to moveable pulley 62, back up to fixed pulley 63, and down to fixed lower pulley 64, from whence a lower reach of cord 15 extends back to connection 60 at handle 25. As handle 25 moves downward from the back swing region, cord 15 causes a relatively small take up on moveable pulley 62. But as handle 25 moves laterally away from upper and lower tension regions occupied by fixed pulleys 61 and 64, cord 15 takes up further on moveable pulley 62 as handle 25 approaches a hitting region. Elastically stretchable cord 65 resists movement of pulley 62 by extending from fixed end 67 downward over fixed pulley 66 and up to moveable pulley 62.

The arrangement of FIG. 9 provides suitable mechanical advantages and suitable elastic cord resistances to lightly resist downward movement of handle 25 from a back swing region, and to more strongly resist horizontal movement of handle 25 toward a hitting region. This provides suitable working exercise for golf swing muscles.

The illustrated embodiments cover only a small fraction of the variations possible with tension cords 14 and 15 extending between upper and lower resistance regions. Fixed ends of cords can be secured in many different locations, and endless combinations of elastomerically deformable cords and tension elements can be used. Any number of pulleys can be deployed, and these also can be arranged in many different ways. The upper resistance region for the two tension elements need not coincide and can be differently positioned.

All workable embodiments, though, will adhere to the basic principals of providing resistance to downward handle movement from an upper resistance region on a back swing side of the exerciser and a resistance element extending between the upper and a lower resistance region to provide resistance to lateral movement of the handle away from the resistance regions and into the hitting region of the swing curve.

I claim:

1. A golf exerciser including a handle that is moved in a simulated golf swing from a back swing region to a hitting region in front of the exerciser and including an elastically deformable tension system connected to the handle to resist handle movement for exercise purposes, the tension system including a first length of a tension element having an end connected to the handle;

the first length of tension element extending from the handle to a first pulley arranged at a level higher than the exerciser's shoulder on a back swing side of the exerciser;

the first length of tension element being reeved over the first pulley to elastically resist movement of the handle downward below the first pulley;

the tension system including a second length of a tension element having a second connection to the handle and extending between the first pulley and a second pulley arranged at a level lower than the hips of the exerciser on the back swing side of the exerciser;

the second length of tension element being reeved over the first and second pulleys to elastically resist movement of the handle laterally away from the upper and lower pulleys and toward the hitting region; and a combined elastic resistance of the first and second lengths of tension elements of the tension system being greatest when the handle moves into the hitting region.

2. The exerciser of claim 1 wherein at least one of the lengths of tension elements is stretchable elastic cord.

3. The exerciser of claim 2 wherein the second cord length is formed of elastically stretchable material arranged as a loop reeved over the first and second pulleys.

4. The exerciser of claim 1 wherein the first length of tension element extends to the handle from the second length of tension element.

5. The exerciser of claim 1 wherein the second connection of the second length of tension element to the handle comprises a low friction element secured to the handle and engaging the second tension element to help the handle move along the length of the second tension element.

6. The exerciser of claim 1 wherein the combined elastic resistance provided by the tension system extends from the handle upward and toward the pulleys as the handle moves into the hitting region.

7. The exerciser of claim 1 wherein the first and second tension elements are cords reeved respectively over the first and second pulleys and over movable position pulleys movement of which is resisted by stretchable elastic cords.

8. A golf swing exerciser comprising:

an exercising handle;

a swing resistance connected to the exercising handle while the handle is moved from a back swing region through a curve to a hitting region in front of a person exercising;

the swing resistance being elastically stretchable and being connected to the handle by first and second cord lengths;

the first cord length extending from the handle to an upper tension pulley arranged at a level above the shoulder of the person exercising and on a back swing side of the person exercising;

the second cord length extending from the handle to the upper tension pulley and from the handle to a lower tension pulley arranged at a level below the hips of the person exercising and on a back swing side of the person exercising;

the first cord length of the swing resistance being arranged to provide a predominant resistance to movement of the handle downward below the upper tension pulley;

the second cord length of the swing resistance being arranged to provide a predominant resistance to movement of the handle laterally away from the upper and lower tension pulleys toward the hitting region; and the predominant resistances of the two cord lengths combine to be greatest as the handle reaches the hitting region.

9. The swing exerciser of claim 8 wherein at least one of the cord lengths is elastically stretchable.

10. The swing exerciser of claim 8 wherein the greatest combined resistances of the two cord lengths extend from the handle laterally and upward.

11. The swing exerciser of claim 8 wherein the second cord length is formed of elastically stretchable material arranged as a loop between the upper and lower tension pulleys.

12. The swing exerciser of claim 11 wherein ends of the loop are connected to the handle.

13. The swing exerciser of claim 11 including a moveable position pulley and wherein the loop is reeved over the moveable position pulley movement of which is resisted by an elastically stretchable element.

14. The swing exerciser of claim 8 including movable position pulleys and wherein the first and second cord lengths are reeved over the movable position pulleys, movement of which is resisted by elastically stretchable elements.

15. The swing exerciser of claim 14 wherein the cord lengths reeved over the upper and lower tension pulleys are elastically stretchable.

16. The swing exerciser of claim 8 including a pulley connecting the second cord length to the handle.

17. A golf swing exerciser having an exercising handle simulating a golf club handle and comprising:

a. pulleys arranged at upper and lower tension regions disposed on a back swing side of a person exercising so that at least one upper pulley is at a level above the shoulders of the person exercising and at least one lower pulley is at a level below the hips of the person exercising;

b. a resistance cord having one end connected to the exercising handle and another end secured in a fixed location;

c. the resistance cord being reeved over an upper tension region pulley to resist downward movement of the handle from a back swing region;

d. the resistance cord being reeved over a pulley on the exercising handle to extend between an upper tension region pulley and a lower tension region pulley to resist movement of the laterally handle away from the upper and lower tension regions and into a hitting region; and e. the resistance cord being reeved over at least one moveable position pulley movement of which is resisted by an elastically deformable element.

18. The exerciser of claim 17 wherein the cord is reeved over a plurality of moveable position pulleys, movement of each of which is resisted by a corresponding plurality of elastically deformable cords.

19. The exerciser of claim 18 wherein the elastically deformable elements are cords are reeved over fixed position pulleys.

20. A golf swing exerciser comprising:

a. pulleys arranged at upper and lower tension regions disposed on a back swing side of a person exercising so that at least one upper pulley is at a level above the shoulders of the person exercising and at least one lower pulley is at a level below the hips of the person exercising;

b. a first resistance cord having one end connected to an exercising handle and another end secured in a fixed location;

c. the first resistance cord being reeved over an upper one of the pulleys to resist downward movement of the handle from a back swing region;

d. a second resistance cord having both ends connected to the handle and being reeved over an upper one of the pulleys and over a lower one of the pulleys to resist movement of the handle away from the upper and lower tension regions and into a hitting region; and e. each of the resistance cords being reeved over at least one moveable position pulley movement of which is resisted by an elastically deformable element.

21. The exerciser of claim 20 wherein the elastically deformable element is a cord reeved over a fixed position pulley.

22. A method of exercising using the golf exerciser of claim 1 wherein the method includes selecting resistances for the first and second lengths of tension elements so that the elastic resistance of the first tension element is comparatively smaller against downward movement of the handle from the backswing region and the elastic resistance of the second tension element is comparatively larger against lateral movement of the handle into the hitting region.

23. A method of providing the swing resistance for the golf exerciser of claim 8, the method comprising selecting resistances for the first and second cord lengths so that the predominant resistance of the first cord length is comparatively smaller than the predominant resistance of the second cord length.

24. A method of providing resistance for the exercising handle of the golf swing exerciser of claim 17, the method comprising arranging the resistance cord so that the resistance to downward movement of the handle from the backswing region is less than the resistance to movement of the handle laterally away from the upper and lower tension regions and into the hitting region.

25. A method of selecting resistances for the resistance cords of the golf swing exerciser of claim 20, the method comprising selecting a first resistance cord to have a comparatively smaller resistance against downward movement of the handle from the backswing region and selecting a second resistance cord to have a comparatively larger resistance to lateral movement of the handle into the hitting region.

* * * * *